US010823172B2

(12) United States Patent
Latham et al.

(10) Patent No.: US 10,823,172 B2
(45) Date of Patent: Nov. 3, 2020

(54) METHOD FOR OPERATING A ROLLING PISTON COMPRESSOR

(71) Applicant: Haier US Appliance Solutions, Inc., Wilmington, DE (US)

(72) Inventors: Joseph Wilson Latham, Louisville, KY (US); Paul Goodjohn, Crestwood, KY (US); Michael Lee McIntyre, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 255 days.

(21) Appl. No.: 15/911,226

(22) Filed: Mar. 5, 2018

(65) Prior Publication Data

US 2019/0271315 A1 Sep. 5, 2019

(51) Int. Cl.

| | |
|---|---|
| ***F04C 28/08*** | (2006.01) |
| ***F04C 18/356*** | (2006.01) |
| ***F04C 29/00*** | (2006.01) |

(52) U.S. Cl.

CPC ..... *F04C 28/08* (2013.01); *F04C 18/356* (2013.01); *F04C 29/0085* (2013.01); *F04C 2270/035* (2013.01); *F04C 2270/052* (2013.01); *F04C 2270/07* (2013.01); *F04C 2270/18* (2013.01); *F04C 2270/70* (2013.01)

(58) Field of Classification Search

CPC .... F04C 18/356; F04C 28/08; F04C 29/0085; F04C 2270/70; F04C 29/07; F04C 29/052; F04C 29/035; F04C 29/18; F04C 29/065; F04C 23/008; H02P 6/06; H02P 6/08; H02P 6/185; H02P 21/09; H02P 21/18; H02K 21/12

See application file for complete search history.

(56) References Cited

U.S. PATENT DOCUMENTS

| | | | | |
|---|---|---|---|---|
| 8,985,984 | B2 | 3/2015 | Ogata et al. | |
| 9,505,289 | B2 | 11/2016 | Kayano et al. | |
| 10,132,304 | B2 * | 11/2018 | Hase | F04C 18/344 |
| 10,273,948 | B1 * | 4/2019 | Goodjohn | F04B 49/20 |
| 10,291,160 | B1 * | 5/2019 | Latham | H02P 6/06 |
| 2006/0125437 | A1 * | 6/2006 | Kitano | F04B 35/04 318/432 |
| 2013/0287602 | A1 | 10/2013 | Suzuki et al. | |

* cited by examiner

*Primary Examiner* — Charles G Freay

(74) *Attorney, Agent, or Firm* — Dority & Manning, P.A.

(57) ABSTRACT

A method of operating a rolling piston rotary compressor includes obtaining an angular position and an angular speed of a rolling piston of the compressor, for example, using a tachometer or shaft encoder or observer. The method further includes obtaining an electromagnetic torque applied by an electric motor that is mechanically coupled to the rolling piston. The method further includes calculating a load torque exerted on the rolling piston based on these obtained values by using a load torque observer model that is formulated using known geometries of the compressor and thermodynamic models for the gas compression process. The operation of the electric motor is then adjusted such that the electromagnetic torque applied by the motor is equivalent to the calculated load torque such that noise and vibrations are minimized.

18 Claims, 6 Drawing Sheets

METHOD FOR OPERATING A ROLLING PISTON COMPRESSOR

FIELD OF THE INVENTION

The present subject matter relates generally to compressors and associated methods of operation, and more particularly, to methods for operating a rolling piston compressor using an adaptive load torque estimation observer.

BACKGROUND OF THE INVENTION

Certain conventional air conditioning and refrigeration systems use sealed systems to move heat from one location to another. Certain sealed systems may perform either a refrigeration cycle (e.g., to perform a cooling operation in an appliance such as a refrigerator) or a heat pump cycle (e.g., to heat an indoor room) depending on the appliance and the desired direction of heat transfer. However, the operating principles of both cycles or modes of operation are identical.

Specifically, sealed systems include a plurality of heat exchangers coupled by a fluid conduit charged with refrigerant. A compressor continuously compresses and circulates the refrigerant through the heat exchangers and an expansion device to perform a vapor-compression cycle to facilitate thermal energy transfer. In most sealed systems, an electric motor directly drives the compressor to compress a refrigerant. Notably, the compression process exerts a very uneven load on the motor. For example, during the compression part of the cycle the load torque increases dramatically, and after the high pressure gas is discharged the other half of the cycle has very little load. This variation in load torque causes variation in the rotor speed during the compression cycle, and thus lots of noise and vibration, especially at slow speed, such as during startup.

Accordingly, a sealed system that compensates for variations in load torque resulting from a compression cycle would be desirable. More particularly, a system and method for regulating the speed of the compressor motor to reduce noise, vibration, and excessive wear on sealed system components would be particularly beneficial.

BRIEF DESCRIPTION OF THE INVENTION

The present disclosure relates generally to a method of operating a rolling piston rotary compressor including obtaining an angular position and an angular speed of a rolling piston of the compressor, for example, using a tachometer or shaft encoder or observer. The method further includes obtaining an electromagnetic torque applied by an electric motor that is mechanically coupled to the rolling piston. The method further includes calculating a load torque exerted on the rolling piston based on these obtained values by using a load torque observer model that is formulated using known geometries of the compressor and thermodynamic models for the gas compression process. The operation of the electric motor is then adjusted such that the electromagnetic torque applied by the motor is equivalent to the calculated load torque such that noise and vibrations are minimized. Additional aspects and advantages of the invention will be set forth in part in the following description, or may be apparent from the description, or may be learned through practice of the invention.

In one exemplary embodiment, a method for operating a rolling piston compressor is provided. The method includes obtaining an angular position and an angular speed of a rolling piston of the compressor and obtaining an electromagnetic torque applied by an electric motor mechanically coupled to the rolling piston. The method further includes calculating a load torque exerted on the rolling piston using a load torque observer model based on the angular position of the rolling piston, the angular speed of the rolling piston, and the electromagnetic torque applied by the electric motor. The method further includes operating the electric motor to adjust the electromagnetic torque to be equivalent to the calculated load torque.

In another exemplary embodiment, a rolling piston compressor is provided including a casing defining a cylindrical cavity defining a central axis, a suction port, and a discharge port. An electric motor includes a drive shaft, the drive shaft extending along the central axis and a rolling piston is positioned within the cylindrical cavity, the rolling piston being eccentrically mounted on the drive shaft. A sliding vane extends from the casing toward the rolling piston to maintain contact with the rolling piston as it rotates about the central axis, the sliding vane and the rolling piston dividing the cylindrical cavity into a suction volume in fluid communication with the suction port and a compression volume in fluid communication with the discharge port. A controller is operably coupled to the electric motor and is configured for obtaining an angular position and an angular speed of the rolling piston and obtaining an electromagnetic torque applied by the electric motor. The controller is further configured for calculating a load torque exerted on the rolling piston using a load torque observer model based on the angular position of the rolling piston, the angular speed of the rolling piston, and the electromagnetic torque applied by the electric motor and operating the electric motor to adjust the electromagnetic torque to be equivalent to the calculated load torque.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
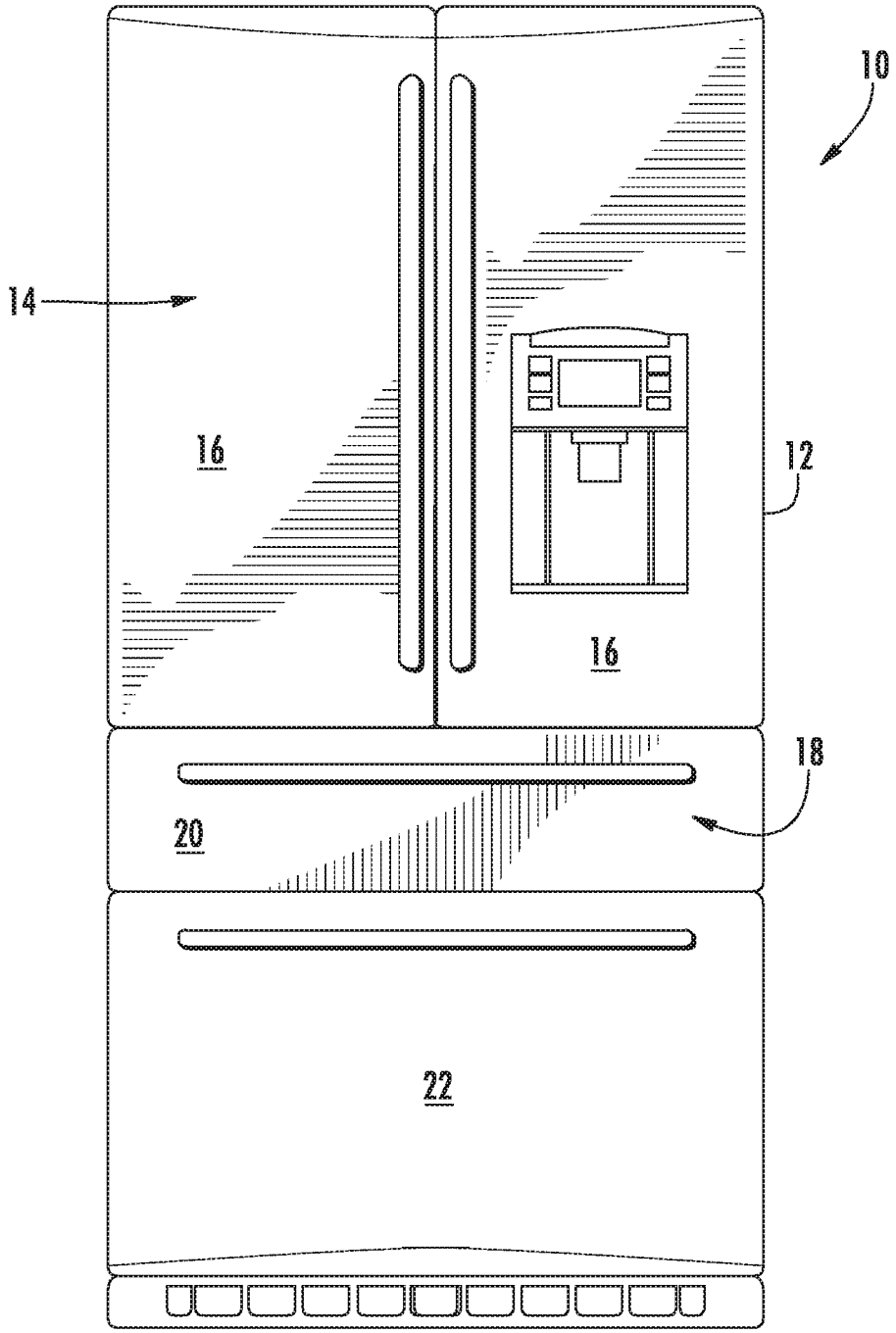
FIG. 1 is a front elevation view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
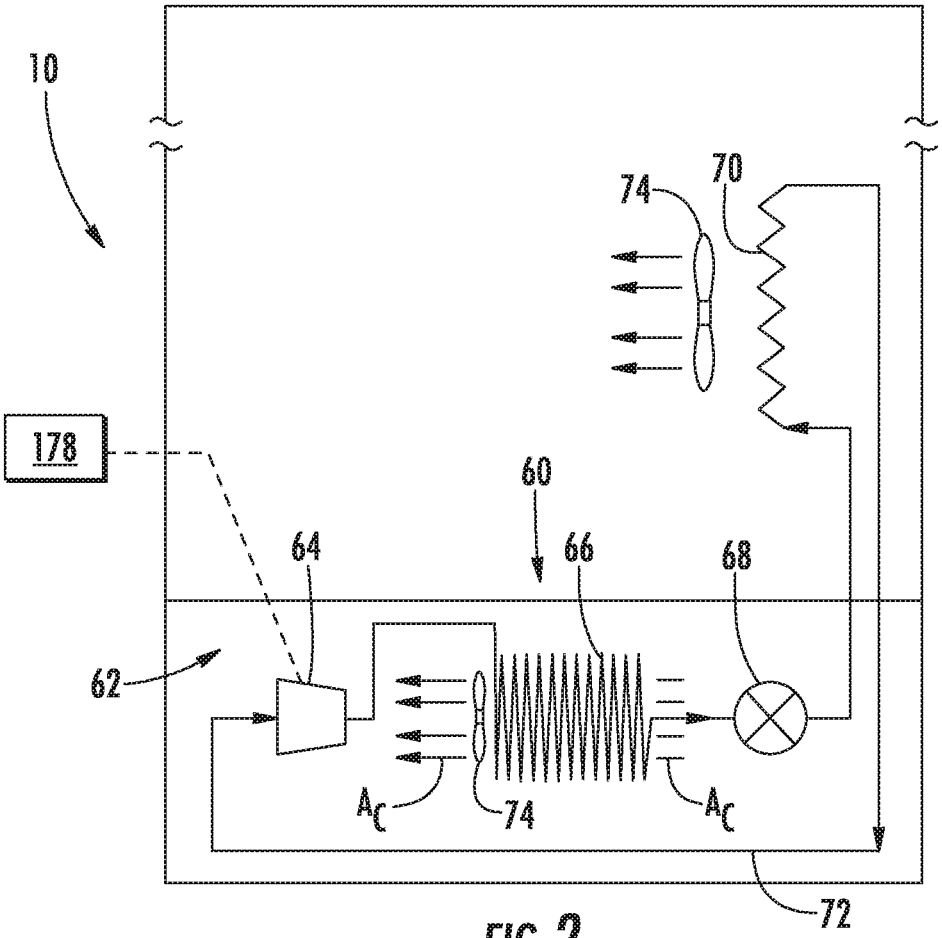
FIG. 2 is a schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in refrigerator appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series by fluid conduit 72 that is charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 74 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

As described above, sealed refrigeration system 60 performs a vapor compression cycle to refrigerate compartments 14, 18 of refrigerator appliance 10. However, as is understood in the art, refrigeration system 60 is a sealed system that may be alternately operated as a refrigeration assembly (and thus perform a refrigeration cycle as described above) or a heat pump (and thus perform a heat pump cycle). Thus, for example, aspects of the present subject matter may similarly be used in a sealed system for an air conditioner unit, e.g., to perform by a refrigeration or cooling cycle and a heat pump or heating cycle. In this regard, when a sealed system is operating in a cooling mode and thus performs a refrigeration cycle, an indoor heat exchanger acts as an evaporator and an outdoor heat exchanger acts as a condenser. Alternatively, when the sealed system is operating in a heating mode and thus performs a heat pump cycle, the indoor heat exchanger acts as a condenser and the outdoor heat exchanger acts as an evaporator.

Figure 3:
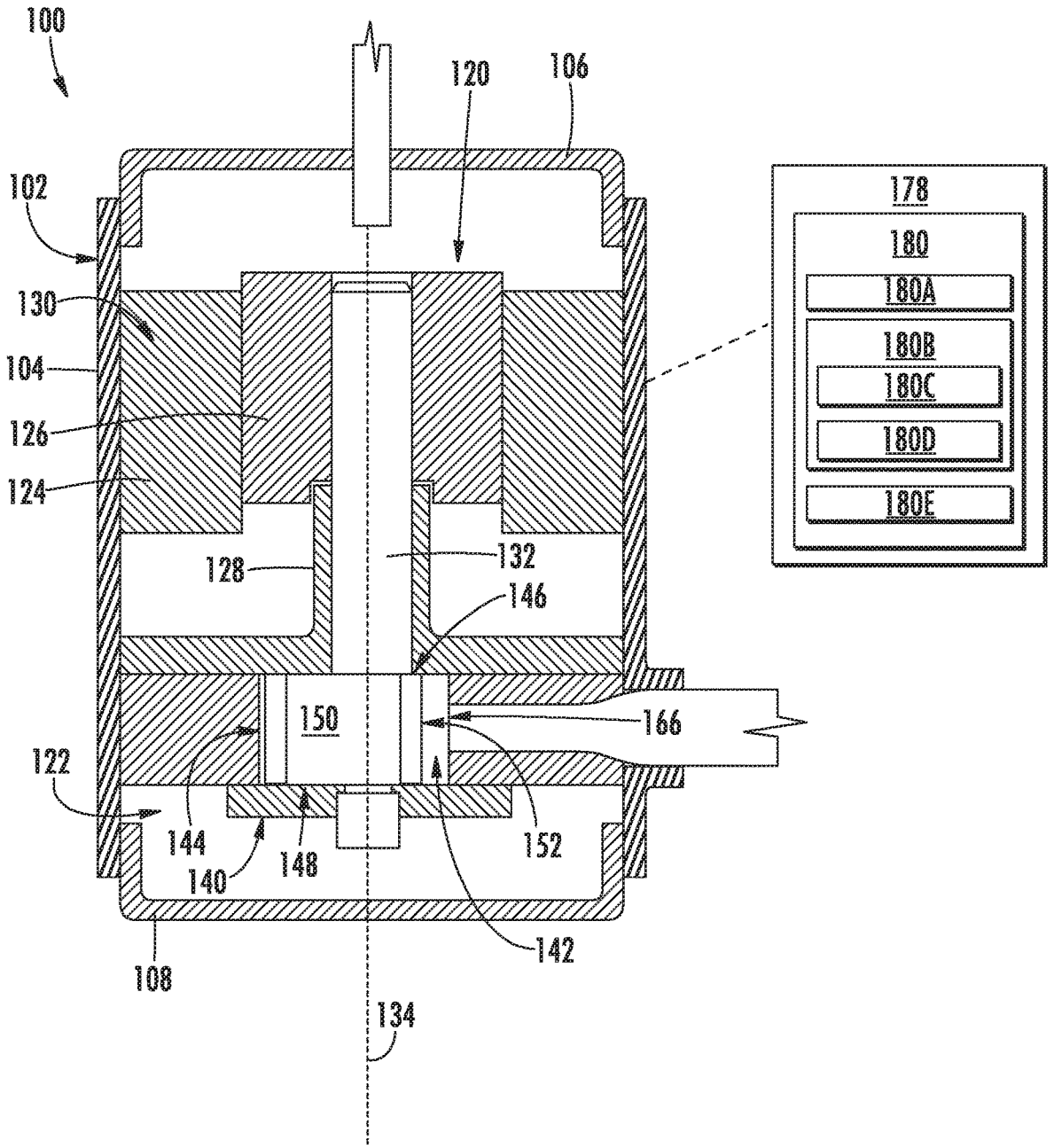
FIG. 3 is a cross sectional view of a rolling piston rotary compressor that may be used in the example refrigerator appliance of FIG. 1 according to an example embodiment of the present subject matter.

Referring now to FIG. 3, a compressor 100 will be described according to an exemplary embodiment of the present subject matter. Compressor 100 may be the same or similar to compressor 64 used in sealed refrigeration system 60. Alternatively, compressor 100 may be used in any other appliance or device for urging a flow of refrigerant through a sealed system. Moreover, it should be appreciated that aspects of the present subject matter may be adapted for use with other compressor types and configurations.

According to the illustrated exemplary embodiment, compressor 100 is a rolling piston rotary compressor including a housing 102 for containing various components of compressor 100. Housing 102 generally includes a cylindrical outer shell 104 that extends between a top shell 106 and a bottom shell 108. Housing 102 may generally form a hermetic or air-tight enclosure for containing compressor 100 components. In this manner, housing 102 generally keeps harmful contaminants outside housing 102 while preventing refrigerant, oil, or other fluids from leaking out of compressor 100.

Compressor 100 includes an electric motor 120 and a pump assembly 122 which are operably coupled and positioned within housing 102. More specifically, referring to FIG. 3, electric motor 120 generally includes a stator 124 positioned within housing 102 and a rotor 126 rotatably positioned within the stator 124. Stator 124 may be mechanically coupled within housing 102 (e.g., by one or more mechanical fasteners or through a compression fit) such that rotation relative to housing 102 is prevented. By contrast, rotor 126 is rotatably mounted using one or more bearings 128. When energized with the appropriate power, rotor 126 is caused to rotate while stator 124 remains fixed. For example, according to an exemplary embodiment, magnetic windings 130 are attached to stator 124. Each magnetic winding 130 may be formed from insulated conductive wire. When assembled, the magnetic windings 130 may be circumferentially positioned about rotor 126 to electromagnetically engage and drive rotation of rotor 122.

In addition, electric motor 120 may include a drive shaft 132 that extends from rotor 126, e.g., for driving pump assembly 122. Specifically, as illustrated, drive shaft 132 extends out of a bottom of rotor 126 along a central axis 134 and may be mechanically coupled to pump assembly 122. It should be appreciated that electric motor 120 may include any suitable type or configuration of motor and is not intended to be limited to the exemplary configuration shown and described herein. For example, the electric motor may be a brushless DC electric motor, e.g., a pancake motor. Alternatively, the electric motor may be an AC motor, an induction motor, a permanent magnet synchronous motor, or any other suitable type of motor.

Figure 4:
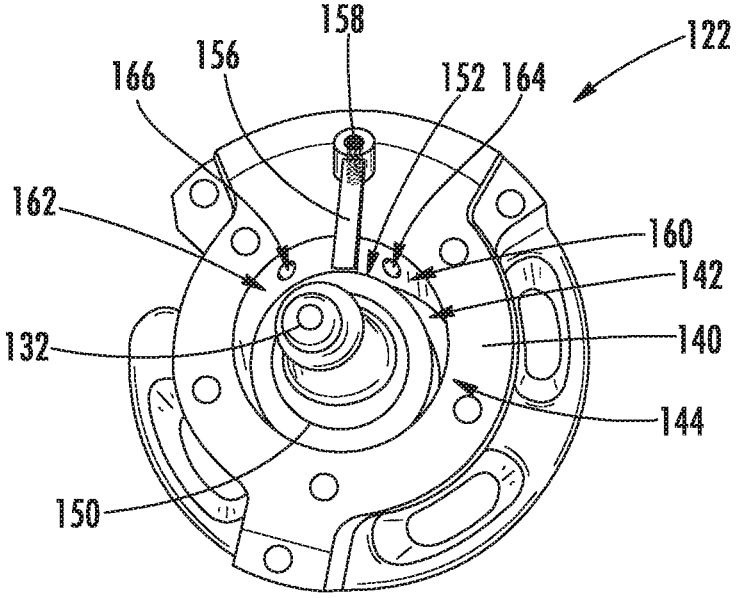
FIG. 4 provides a perspective cross sectional view of the exemplary rolling piston rotary compressor of FIG. 3.
Figure 5:
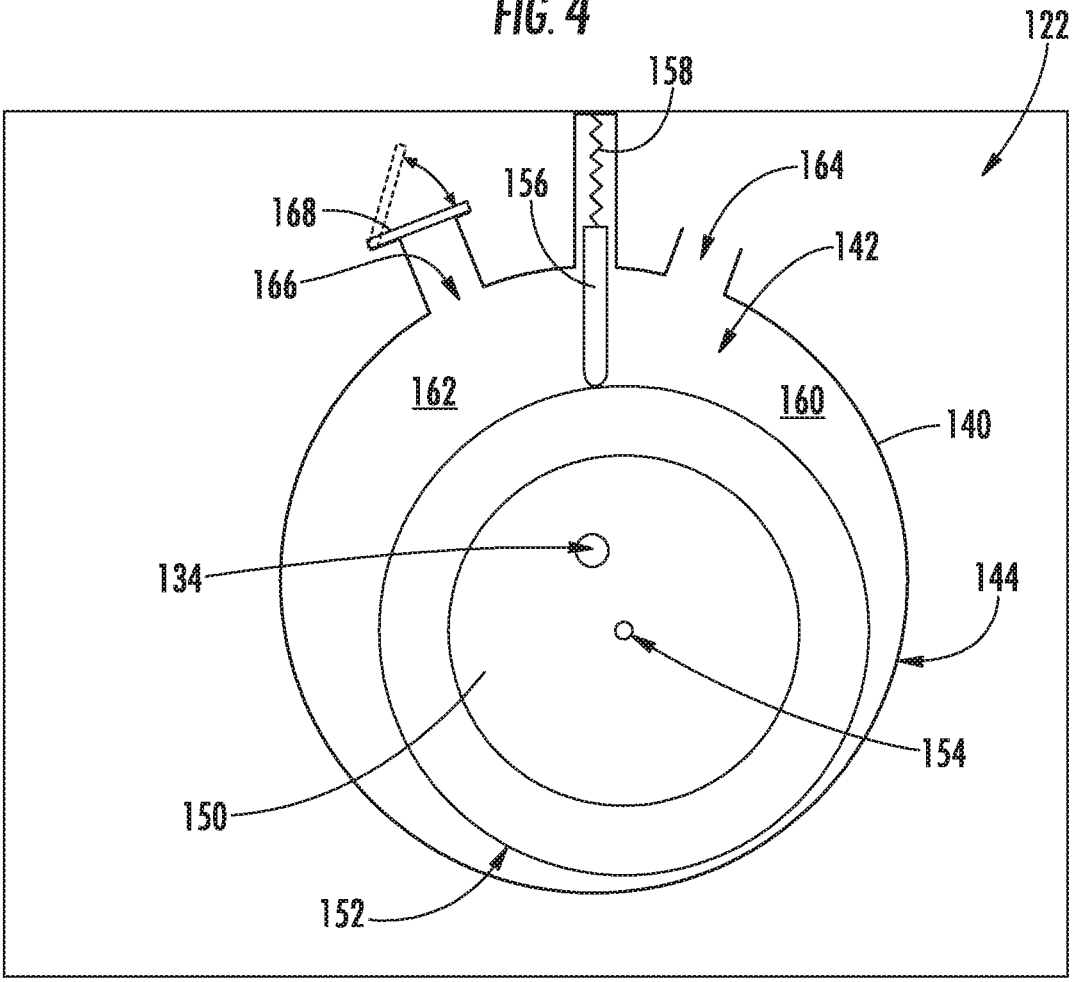
FIG. 5 provides a schematic, cross sectional view of the example rolling piston rotary compressor of FIG. 3.

Referring now to FIGS. 3 through 5, pump assembly 122 will be described in more detail according to an exemplary embodiment. As illustrated, pump assembly 122 is positioned within housing 102 and includes a casing 140 that defines a cylindrical cavity 142 within which the refrigerant compression occurs. Specifically, according to the illustrated embodiment, cylindrical cavity 142 defines a central axis which coincides with central axis 134 of drive shaft 132. Specifically, casing 140 may be formed from a cylindrical outer wall 144 that extends between a top wall 146 and a bottom wall 148 that are spaced apart along central axis 134.

As illustrated, a rolling piston 150 is positioned within cylindrical cavity 142 and is generally used for compressing refrigerant. Notably, rolling piston 150 may extend between top wall 146 and bottom wall 148 and define a cylindrical outer surface 152 that rolls along cylindrical outer wall 144 of casing 140. More specifically, rolling piston 150 is eccentrically mounted on drive shaft 132, e.g., such that a center of piston mass 154 is offset or not coincident with central axis 134.

In addition, pump assembly 122 includes a sliding vane 156 that extends from casing 140 toward rolling piston 150 to maintain contact with cylindrical outer surface 152 of rolling piston 150 as it rotates about central axis 134. Similar to rolling piston 150, sliding vane 156 generally extends between top wall 146 and bottom wall 148 of casing 140. Sliding vane 156 is urged into constant contact with rolling piston 150, e.g., using a spring element 158, such as a coiled mechanical spring.

In this manner, sliding vane 156 and rolling piston 150 divide cylindrical cavity 142 into a suction volume 160 and a compression volume 162. Casing 140 further defines a suction port 164 in fluid communication with suction volume 160 and a discharge port 166 in fluid communication with compression volume 162. In general, the rolling piston compressor 100 varies compression volume 162 while rolling piston 150 performs an eccentric rotary or orbiting motion in cylindrical cavity 142 about central axis 134. Sliding vane 156 maintains contact with cylindrical outer surface 152 to maintain a seal between suction volume 160 and compression volume 162.

Pump assembly 122 may further include a discharge valve 168 that is operably coupled to discharge port 166. In this manner, discharge valve 168 prevents the discharge of compressed refrigerant from compression volume 162 until a desired pressure is reached. In addition, discharge valve 168 may prevent the backflow of refrigerant into compression volume 162 from discharge port 166.

Operation of compressor 100 is controlled by a controller or processing device 178 (FIG. 3) that is operatively coupled to electric motor 120 for regulating operation of compressor 100, e.g., by selectively energizing electric motor 120. Specifically, controller 178 is in operative communication with the motor and may selectively energize stator 124 to drive rotor 126 and compress refrigerant as described above. Thus, controller 178 may generally be configured for executing selected methods of operating compressor 100, e.g., as described below. As described in more detail below, controller 178 may include a memory and microprocessor, such as a general or special purpose microprocessor operable to execute programming instructions or micro-control code associated with methods described herein. Alternatively, controller 178 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Compressor 100 and other components of the associated appliance may be in communication with controller 178 via one or more signal lines or shared communication busses.

FIG. 3 depicts certain components of controller 178 according to example embodiments of the present disclosure. Controller 178 can include one or more computing device(s) 180 which may be used to implement methods as described herein. Computing device(s) 180 can include one or more processor(s) 180A and one or more memory device(s) 180B. The one or more processor(s) 180A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 180B can include one or more non-transitory computer-readable storage medium(s), such as RAM, ROM, EEPROM, EPROM, flash memory devices, magnetic disks, etc., and/or combinations thereof.

The memory device(s) 180B can include one or more computer-readable media and can store information accessible by the one or more processor(s) 180A, including instructions 180C that can be executed by the one or more processor(s) 180A. For instance, the memory device(s) 180B can store instructions 180C for running one or more software applications, displaying a user interface, receiving user input, processing user input, etc. In some implementations, the instructions 180C can be executed by the one or more processor(s) 180A to cause the one or more processor(s) 180A to perform operations, e.g., such as one or more portions of methods described herein. The instructions 180C can be software written in any suitable programming language or can be implemented in hardware. Additionally, and/or alternatively, the instructions 180C can be executed in logically and/or virtually separate threads on processor(s) 180A.

The one or more memory device(s) 180B can also store data 180D that can be retrieved, manipulated, created, or stored by the one or more processor(s) 180A. The data 180D can include, for instance, data to facilitate performance of methods described herein. The data 180D can be stored in one or more database(s). The one or more database(s) can be connected to controller 178 by a high bandwidth LAN or WAN, or can also be connected to controller through network(s) (not shown). The one or more database(s) can be split up so that they are located in multiple locales. In some implementations, the data 180D can be received from another device.

The computing device(s) 180 can also include a communication module or interface 180E used to communicate with one or more other component(s) of controller 178 or refrigerator appliance 10 over the network(s). The communication interface 180E can include any suitable components for interfacing with one or more network(s), including for example, transmitters, receivers, ports, controllers, antennas, or other suitable components.

Figure 6:
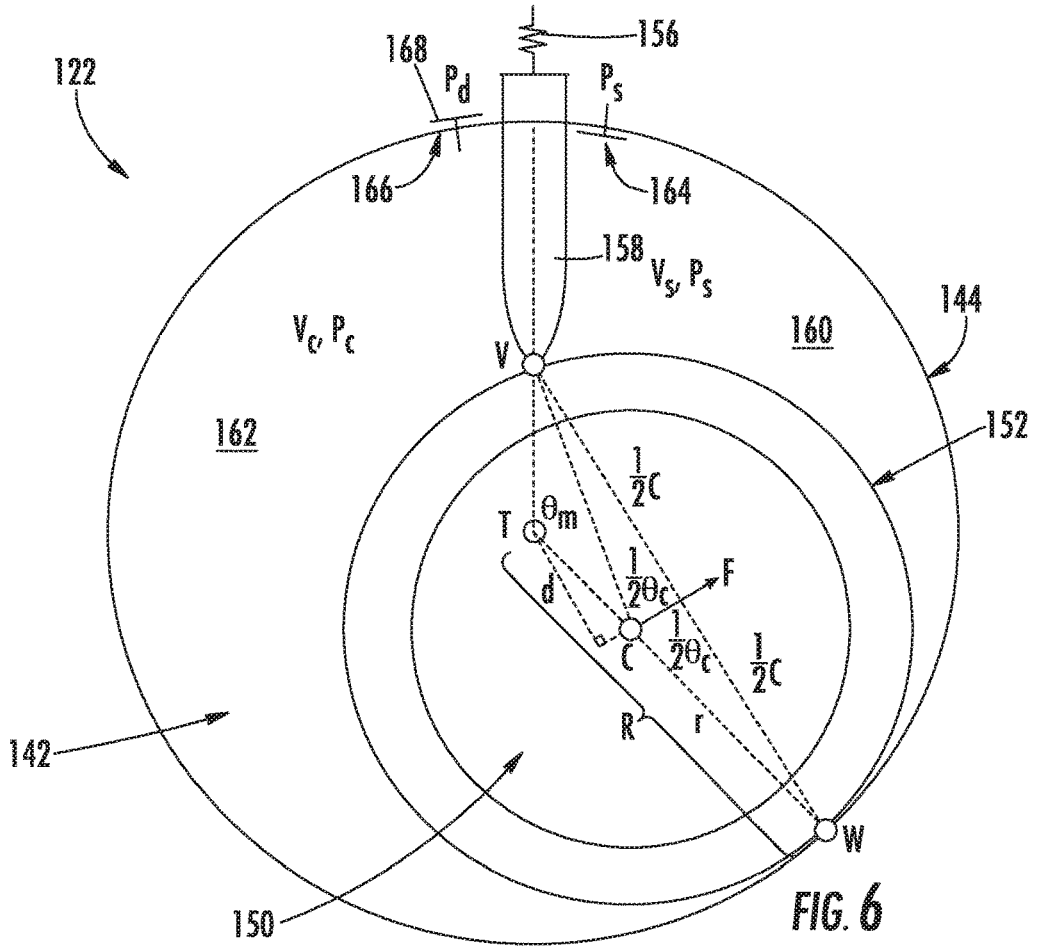
FIG. 6 provides a schematic, cross sectional view of the exemplary rolling piston rotary compressor including the geometric relationship and forces acting on the rolling piston.

Referring now specifically to FIG. 6, a schematic, cross sectional view of an exemplary rolling piston rotary compressor is provided. Specifically, FIG. 6 illustrates the geometric relationship between the eccentrically mounted rolling piston 150, the cylindrical cavity 142, and the sliding vane 156. Also illustrated are various forces exerted on rolling piston 150, along with an identification of the various chambers and their compression volumes. For convenience and to facilitate discussion below, a list of the system parameters associated with the load torque estimation observer is provided below in Table 1. However, it should be appreciated that fewer than all parameters may be listed here.

TABLE 1

List of Load Torque Estimation Observer Variables and Parameters

| Symbol | Parameter/Variable |
|---|---|
| $\theta_m$, $\dot{\theta}_m$, $\ddot{\theta}_m$ | Angle/speed/acceleration between the piston and the vane |
| T | axis of piston rotation (i.e., coincides with central axis 134) |
| C | center of piston mass |
| V | point of contact between piston and vane |
| W | point of contact between piston and wall |
| R | radius of compression chamber (i.e., cylindrical cavity 142) |
| r | radius of eccentrically mounted rolling piston 150 |
| $V_c$ | compression chamber volume (162) |
| $P_c$ | compression chamber pressure |
| $V_s$ | suction chamber volume (160) |
| $P_s$ | suction chamber pressure |
| $P_d$ | discharge pressure |
| l | depth of compression chamber (not illustrated) |
| n | specific heat ratio of the working gas |

As explained briefly above, the compression process exerts a very uneven load on rolling piston 150 and thus electric motor 120 and compressor 100 in general. For example, during the compression part of the cycle the load torque increases dramatically, and after the high pressure gas is discharged the other half of the cycle has very little load. Specifically, referring briefly to FIG. 7, a plot illustrating the relationship between piston angle ($\theta_m$) of a rolling piston and a resulting load torque exerted on the rolling piston according to an exemplary embodiment of the present subject matter. Such a variation in load torque causes variation in the rotor speed during the compression cycle, and thus lots of noise and vibration, especially at slow speed, such as during startup. The methods described herein are intended at least in part to minimize such variations and vibrations.

Figure 8:
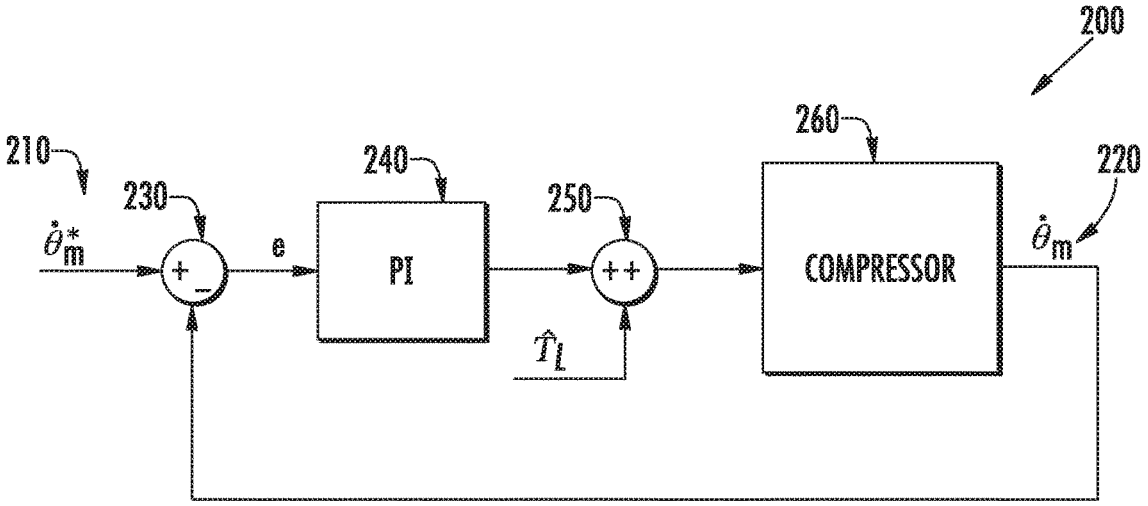
FIG. 8 provides an exemplary control schematic for regulating operation of the exemplary rolling piston rotary compressor of FIG. 3 according to an exemplary embodiment.
Figure 9:
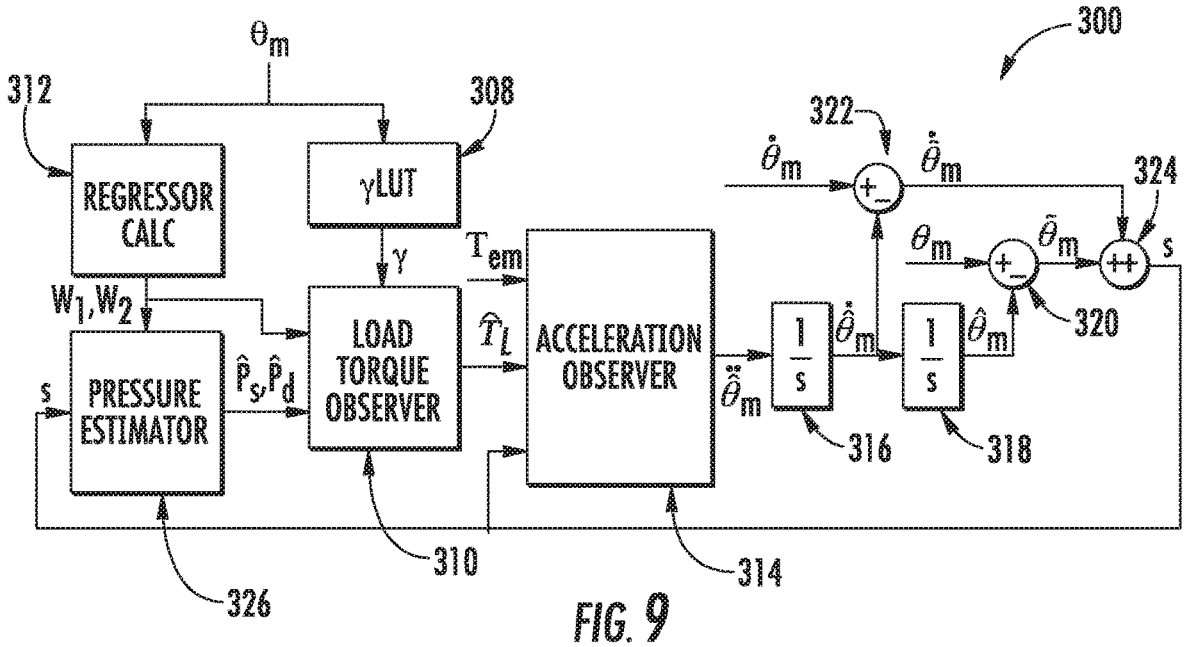
FIG. 9 provides a method for operating a rotary compressor according to an exemplary embodiment of the present subject matter.

Referring now to FIGS. 8 and 9, an exemplary flow diagram or method 200 of operating a rotary compressor will be described according to an exemplary embodiment of the present subject matter. Method 200 may be used to operate any suitable compressor. For example, method 200 may be used to operate rolling piston compressor 100 or may be adapted for controlling any other suitable compressor type and configuration. According to an exemplary embodiment, controller 178 of refrigerator appliance 10 may be programmed or configured to implement method 200. Thus, method 200 is discussed in greater detail below with reference to rolling piston compressor 100. Utilizing method 200, the motor of compressor 100 may be operating according to various control methods.

As illustrated in FIG. 8, at the start of method 200, step 210 includes obtaining a target piston angular speed value or a reference speed ($\dot{\theta}$*). Specifically, continuing the example above, reference speed $\dot{\theta}_m$* may be the desired speed of compressor 100 to achieve the desired refrigerant flow and operation of sealed system 60. For example, reference speed $\dot{\theta}_m$* may be set by a user or determined by controller 178 in response to one or more user inputs or system commands determined responsive to a measured temperature of compartments 14, 18.

In addition, step 220 includes obtaining an angular position of the rolling piston ($\theta_m$) and an angular speed of the rolling piston ($\dot{\theta}_m$). As explained above, these values may be determined using any suitable sensors or detection methods, such as encoders, tachometers, observers, etc. At step 230, a speed error (e) is calculated between the reference speed ($\dot{\theta}_m$*) and the measured angular speed ($\dot{\theta}_m$). The speed error (e) is thus governed by the following equation:

$$e \triangleq \dot{\theta}_m - \dot{\theta}_m$$

The speed error (e) is fed into a speed controller including a proportional-integral (PI) term at step 240 in order to reduce the speed error (e), i.e., to drive angular speed ($\dot{\theta}_m$) to the reference speed ($\dot{\theta}_m$*). Specifically, the speed controller includes a feedforward term and a feedback term. The feedforward term is the observed load torque ($\hat{T}_L$). The speed error (e) is used in the feedback term in the controller, where the speed controller has a proportional gain ($k_P$) and an integral gain ($k_I$), which may be set by a user, may be empirically determined, or may be set in any other suitable manner. At step 250, the feedback term is summed with the observed load torque ($\hat{T}_L$) to generate a torque input ($T_{em}$) to the compressor. Specifically, at step 260, the electric motor is energized to generate torque input ($T_{em}$) for driving the compressor. As used below, it should be appreciated that 1/s is an integrator notation used herein for simplicity, and that this may be replaced by standard time-domain integrated symbols, such as $\int_0^t e(\sigma)\, d\sigma$. The speed controller including a PI term for determining the torque input ($T_{em}$) may be modeled as shown in the following equation:

$$T_{em} = \hat{T}_L + \left(k_P + k_P \frac{1}{s}\right) e$$

As used herein, the terms observer and estimate both refer to mathematical approximations of unknown signals, the difference being that an observer approximates a time-varying signal (one with non-zero derivative) whereas an estimator approximates a constant or near-constant signal (derivative approx. equal zero). Both observers and estimates are typically denoted with a hat (ˆ) over the variable in the formulations set forth herein.

As described herein, the speed controller may be the primary control for operation of rotary compressor 100 during method 200. In this regard, the speed controller may be configured for adjusting the supply voltage to rotary compressor 100 to achieve the desired torque input ($T_{em}$). Specifically, according to one exemplary embodiment, a separate cascaded controller (which could be either a torque or current controller) could be used to achieve the desired torque input ($T_{em}$) for the speed controller. For example, the separate torque input controller could be another PI controller, or could comprise any other suitable control algorithm. The angular speed ($\dot{\theta}_m$) may be measured or estimated utilizing any suitable method or mechanism. For example, a shaft speed encoder may measure the speed of the motor drive shaft, a tachometer may be used, or the back electromotive force (EMF) of the electric motor may be measured and used to determine $\dot{\theta}_m$. Other suitable methods for determining $\theta_m$, $\dot{\theta}_m$ and $T_{em}$ are possible and may be used according to alternative embodiments of the present subject matter.

Referring now specifically to FIG. 9, an observer block diagram or method 300 of observing the load torque ($T_L$) exerted on a rolling piston of a compressor is provided according to an exemplary embodiment. For example, method 300 can be using for observing the load torque ($T_L$) exerted on rolling piston 150 during operation. Notably, this observed load torque ($\hat{T}_L$) may be used as an input to the speed controller illustrated and described with respect to FIG. 8 to determine the desired torque input ($T_{em}$) for minimizing noise and vibrations.

FIG. 9 and the associated description below provide an explanation and formulation of a load torque observer or model that may be used to implement method 300 and observe the load torque ($T_L$) acting on a rolling piston. In addition, the motor torque input ($T_{em}$) that facilitates the cancelling or compensation for the piston load torque ($T_L$) is described. In this manner, a suitable controller, such as an appliance controller or a dedicated motor controller, may be used to operate the drive motor such that the rolling piston compressor operates to minimize speed variation, thereby reducing noise and vibrations during operation.

To simplify explanation of the formulation of the load torque estimation observer, certain steps in the formulation process may be omitted, particularly where the mathematics are simple or the derivation is implied. The description of the control algorithm and methods 200, 300 are intended to describe only a single method of formulating a load torque observer and regulating compressor 100. According to alternative embodiments, assumptions may be made to simplify the calculation, e.g., where such an assumption simplifies the computational requirements of controller without sacrificing accuracy beyond a suitable degree.

Figure 7:
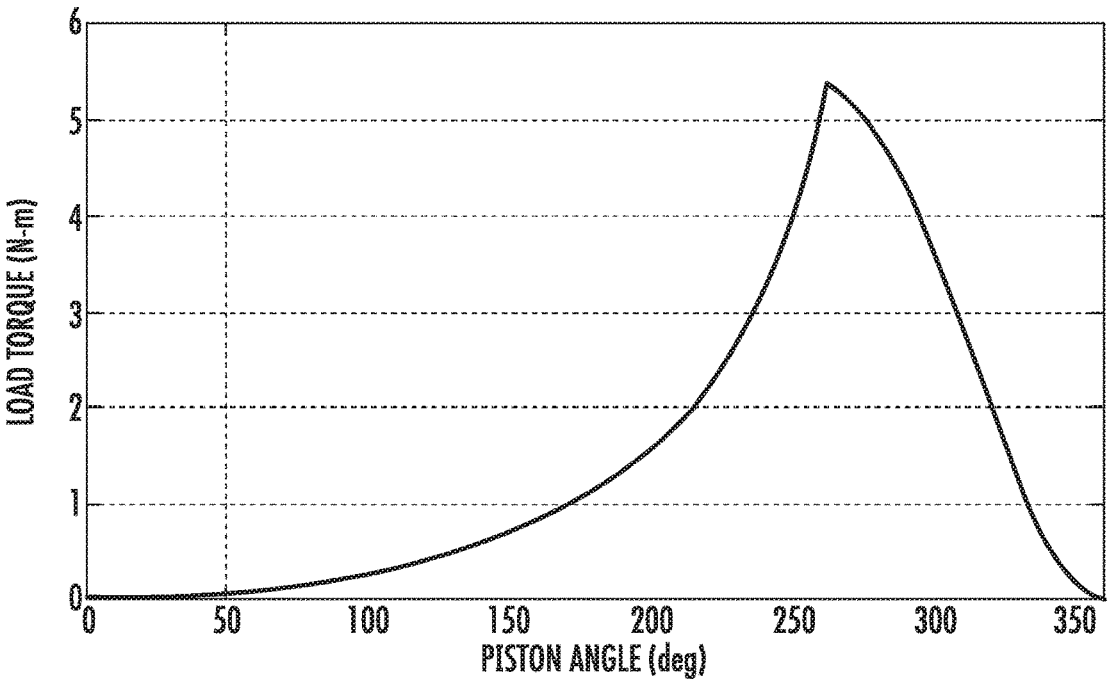
FIG. 7 provides a plot illustrating the relationship between a piston angle of a rolling piston and a resulting load torque exerted on the rolling piston according to an exemplary embodiment of the present subject matter.

As an initial matter, in order to ensure quiet operation of the rolling piston rotary compressor, it is desirable that the rotor (drive shaft) and rolling piston rotate at a constant speed. In other words, it is generally desirable to maintain the angular acceleration of the piston at zero (i.e., $\ddot{\theta}_m=0$). In order to provide a coordinate system and frame of reference for the discussion herein, $\theta_m=0°$ corresponds to top dead center (TDC). Notably, the general mechanical dynamic equation for the compressor is as follows:

$$J\ddot{\theta}_m=T_{em}-T_L$$

where:

J is the combined moment of inertia for the motor and piston $T_{em}$ is the electromagnetic torque applied by the motor $T_L$ is the torque applied on the rolling piston by the load Therefore, in order to rotate the rolling piston at a constant speed, e.g., to minimize noise and vibration, it is desirable to operate the motor to apply an electromagnetic torque ($T_{em}$) that is equivalent to the torque load ($T_L$) on the rolling piston. However, given the highly nonlinear torque applied to the rolling piston, it is difficult to maintain $T_{em}$ the same as $T_L$. More specifically, as illustrated in FIG. 7, the torque load $T_L$ applied on the rolling piston varies non-linearly depending on the angular position of the rolling piston ($\theta_m$).

Aspects of the present invention relate to developing and implementing an load torque observer, i.e., a model for determining or predicting the exerted load torque ($T_L$) based on the compressor mechanical dynamics and model the forces generated during a compression cycle in an effort to generate a control algorithm for the motor to compensate for vibrations generated as a result of the load torque ($T_L$). Specifically, the load torque observer is used in a speed controller to cancel out the load torque ($T_L$) to achieve the desired speed regulation to reduce noise and vibrations. For example, one exemplary proportional-integral (PI) controller is described below in reference to FIG. 8 and an exemplary load torque observer model is described in reference to FIG. 9.

Although the load torque observer is developed for a rolling piston type rotary compressor, it should be appreciated that aspects of the present subject matter may also applied to other types of rotary compressors and other compressors as well. For example, similar mathematical modeling of the mechanical dynamics associated with rotary vane compressors or any other suitable type or configuration of compressor may be used. The rolling piston type compressor is used herein only as an exemplary embodiment for the purpose of illustration and is not intended to limit the scope of the present subject matter in any manner.

The load torque observer described herein relies on several assumptions about the compressor and the associated mechanical dynamics as well as thermodynamic properties of the refrigerant. Several of these assumptions are described below according to an exemplary embodiment. However, it should be appreciated that these assumptions may be manipulated or varied, other assumptions may be made, and other modifications may be made to the load torque observer model while remaining within the present subject matter. Several of the assumptions used in the modeling are described below.

The signals $\theta_m$, $\dot{\theta}_m$, and $T_{em}$ are known and bounded, and $\theta_m$ is referenced such that at top dead center (TDC), $\theta_m$ is equal to zero. As best shown in FIG. 6, $\theta_m$ is measured as the angle between a first line that extends between an axis of piston rotation (T, i.e., which coincides with central axis 134) and a point of contact between the rolling piston and the vane (V) and a second line that extends between the axis of piston rotation T and a center of the piston mass (C) (e.g., also referred to by reference numeral 154). In addition, system parameters such as combined moment of inertia for the motor and piston U), the specific heat ratio of the working gas or refrigerant (n), as well as all other geometric dimensions of the compressor are known. The positive unknown parameters such as the suction pressure ($P_s$) and the discharge pressure ($P_d$) are bounded and treated as constants such that the rate of change of the suction pressure ($\dot{P}_s$) and the rate of change of the discharge pressure ($\dot{P}_d$) are approximately equal to zero. It should be appreciated that as used herein, terms of approximation, such as "approximately," "substantially," or "about," refer to being within a ten percent margin of error.

In addition, the load torque observer model developed herein assumes that the gas compression process is an isentropic process. In this regard, isentropic (or adiabatic) compression of gas is an idealized thermodynamic process which work transfers of the system are frictionless, and there is no flow of heat energy either into or out of the compressed refrigerant. In addition, it is assumed that the force of gas compression is the dominant contributor to the load torque ($T_L$). Furthermore, it is assumed that piston 150 and cylindrical outer surface 152 act as a single body, i.e., that forces acting on cylindrical outer surface 152 are transferred identically to piston 150. In addition, the volume displaced by sliding vane 156 is neglected herein.

As described briefly above, during operation of the compressor, the rolling piston is mounted to the rotor of the electric motor such that it rotates and translates within the cylindrical cavity. Notably, the rolling piston is mounted off center from the rotor, i.e., such that the drive axis of the rotor is not coincident with the central axis of the rolling piston. In this manner, for example, as the rolling piston rotates clockwise, the compression volume $V_c$ decreases causing gas compression and the increase of the pressure in the compression chamber $P_c$. Simultaneously, additional refrigerant is pulled in through the suction port into the suction volume $V_s$ for compression during the next piston rotation.

The rolling piston continues to compress the gas until the pressure in the compression chamber exceeds the discharge pressure $P_d$, when the discharge valve (e.g., such as discharge valve 168) opens, allowing the pressurized gas to be expelled causing the pressure in the compression chamber $P_c$ to hold constant at the discharge pressure $P_d$ until top dead center is passed. In this regard, the discharge valve may be a one-way valve that has a cracking pressure equal to the discharge pressure $P_d$. Alternatively, any other suitable valve may be used to regulate the discharge of gas from the compression chamber.

As the rolling piston rotates, thereby compressing the gas in the compression chamber, it simultaneously expands the volume of the suction chamber $V_s$. This volume expansion creates a negative pressure that opens the suction valve or otherwise draws in new gas into the cylinder from the inlet conduit. Notably, when the rolling piston crosses top dead center (TDC), the compression volume $V_c$ reduces to zero and the rolling piston begins compressing what was formerly the volume of the suction chamber $V_s$ and a new suction volume $V_s$ begins increasing from zero as the rolling piston rotates through another rotation past TDC.

As illustrated in FIG. 6, the geometry of an exemplary rolling piston is illustrated. From this geometry, the compression volume $V_c$ can be represented as a function of the rolling piston angular position $\theta_m$ according to the following equation:

$$V_c \triangleq \left(\frac{2\pi-\theta_m}{2}\right)R^2 l - \left[\pi r - \frac{1}{2}(\theta_c r + (R-r)\sin\theta_c)\right] rl$$

-continued $$\text{where } \theta_c \triangleq \theta_m + \sin^{-1}\left(\frac{R-r}{r}\sin\theta_m\right)$$

Going further, assuming isentropic compression, the pressure in the compression chamber $P_c$ can be modeled by a piecewise function depending on whether the pressure in the compression chamber $P_c$ has exceeded the discharge pressure $P_d$. More specifically, the pressure in the compression chamber $P_c$ may be modeled as follows:

| Stage | Piecewise Condition | Chamber Pressure $P_c(t)$ |
|---|---|---|
| Compression | $P_c(t) < P_d$ | $P_s\left(\frac{V_{TDC}}{V_c(\theta_m)}\right)^{\pi}$ |
| Discharge | $P_c(t) \geq P_d$ | $P_d$ |

Notably, in the above piecewise function, $V_{TDC}$ is the volume of the compression chamber when the rolling piston is at top dead center, e.g., when the piston angle ($\theta_m$) is equal to zero. Using the equation above for the compression volume ($V_c$) and inserting $\theta_m=0$ simplifies $V_{TDC}$ as follows:

$$V_{TDC} \triangleq V_c(\theta_m=0) \triangleq \pi R^2 l - \pi r^2 l \triangleq \pi l(R^2-r^2)$$

The force vector $\vec{F}$ acting on the rolling piston has a magnitude that is a function of the compressor chamber pressure $P_c$ and the suction chamber pressure $P_s$ as follows:

$$d \triangleq (R-r)\sin\frac{\theta_c}{2}$$

This force acts at a distance d from the center of rotation C, which can be calculated as:

$$|\vec{F}| \triangleq (P_c - P_s)A$$

$$\text{where } A \triangleq 2rl\sin\frac{\theta_c}{2}$$

From this, the torque acting against the cylinder may be calculated using the following formula:

$$T_L \triangleq |\vec{F}|\cdot d$$

By substituting the definition for $|\vec{F}|$ formulated above, the load torque equation from can be rewritten as follows:

$$T_L = \gamma(\theta_m)(P_c - P_s)$$

where $\gamma \triangleq A\cdot d$

Notably, A and d are known terms determined based on the geometry of the rolling piston and its angular position ($\theta_m$) within the cylindrical cavity. Thus, because $\gamma$ is dependent only on the angular position of the rolling piston which is bounded between 0 and $2\pi$, one exemplary embodiment of the present subject matter involves generating a lookup table (e.g., as shown at step 308 in FIG. 9) in order to reduce necessary computations during operation of the compressor.

Notably, as shown above, the load torque ($T_L$) depends on two unknowns: the pressure of the compression chamber ($P_C$), which is time varying, and the pressure within the suction chamber ($P_S$), which is approximately constant. By rewriting the torque load equation in a form which consists only of unknown constants, adaptive methods may be used to estimate those constants and thus provide an observer model through which the torque load can be observed. One exemplary method of using adaptive methods to estimate unknown constants and determining load torque is described below. However, it should be appreciated that other methods of estimating these constants are possible and within the scope of the present subject matter.

As indicated by step 310 in FIG. 9, method 300 included obtaining the torque load as a function of the pressure of the compression chamber ($P_c$) and the pressure within the suction chamber ($P_s$). Specifically, the formulation of the torque load observer at step 310 is achieved by substituting the piecewise definition for $P_c$. (as formulated above) and separating ($P_c$–$P_s$) into known time-varying terms designated as $W \triangleq [W_1\ W_2]$ and unknown constants designated as $P \triangleq [P_s\ P_d]^T$ such that:

$$(P_c - P_s) = WP = [W_1\ W_2]\begin{bmatrix} P_s \\ P_d \end{bmatrix} = W_1 P_s + W_2 P_d$$

$$\text{and thus } T_L = \gamma WP$$

The piecewise regressor terms $W \triangleq [W_1\ W_2]$ may be calculated (as shown by step 312 in FIG. 9) as a piecewise function depending on whether the pressure of the compression chamber ($P_c$) has exceeded the discharge pressure ($P_d$). Specifically, the piecewise regressor terms $W \triangleq [W_1\ W_2]$ are defined according to the table below:

| Stage | Piecewise Condition | $W_1$ | $W_2$ |
|---|---|---|---|
| Compression | $P_c(t) < P_d$ | $\left(\frac{V_{TDC}}{V_c(\theta_m)}\right)^n - 1$ | 0 |
| Discharge | $P_c(t) \geq P_d$ | −1 | 1 |

Now revisiting the general mechanical dynamic equation described above, and substituting $T_L = \gamma WP$, the governing equation becomes:

$$J\ddot{\theta}_m = T_{em} - \gamma WP$$

In the above equation, $T_{em}$, $\theta_m$, and $\dot{\theta}_m$ are known and incorporating the equations above reveals two unknown constants in the right hand side: $P_s$ and $P_d$. To generate an observer for the piston angular acceleration ($\ddot{\theta}_m$), step 314 includes using estimates for $P_s$ and $P_d$, referred to herein as $\hat{P}_s$ and $\hat{P}_d$, respectively, such that the following acceleration observer equation may be formulated:

$$\ddot{\hat{\theta}}_m \triangleq \frac{1}{J}\left[T_{em} - \gamma W\hat{P}\right] + (k_1 + 1)s$$

where s is a feedback error defined below

Then, by integrating the above equation twice, an observed angular speed ($\dot{\hat{\theta}}_m$) may be obtained by integrating at step 316 and the angular position ($\hat{\theta}_m$) may be be obtain by integrating at step 318. After these values are obtained, they may be used to obtain error signals (indicated with a tilde ~ hat) which can be used to update $\hat{P}_s$ and $\hat{P}_d$, as well as $\dot{\tilde{\theta}}_m$. Specifically:

$\tilde{\theta}_m \triangleq \theta_m - \hat{\theta}_m$ (determined at step 320)

$\dot{\tilde{\theta}}_m \triangleq \dot{\theta}_m - \hat{\theta}_m$ (determined at step 322)

$s \triangleq \dot{\tilde{\theta}}_m + \tilde{\theta}_m$ (determined at step 324)

Therefore the parameter s is a feedback term that may be returned to the acceleration observer model described above. In addition, the feedback term is used in the parameter update equations described below to update $\hat{P}_s$ and $\hat{P}_d$. Specifically, the parameter update equations may be formulated as follows, where $k_p$ is a positive estimator gain:

$$\dot{\hat{P}} \triangleq -\frac{1}{J}\gamma\Gamma W^T s \begin{cases} \dot{\hat{P}}_s \triangleq -\frac{k_P}{J} W_1 s \\ \dot{\hat{P}}_d \triangleq -\frac{k_P}{J} W_2 s \end{cases}$$

$$\text{where } \Gamma \triangleq \begin{bmatrix} k_p & 0 \\ 0 & k_p \end{bmatrix}$$

By integrating both sides once, the suction pressure estimate ($\hat{P}_s$) and the discharge pressure estimate ($\hat{P}_d$) may be determined at step 326. These values are then used in the load torque observer equation. Notably, the pressure estimates for the suction pressure ($\hat{P}_s$) and the discharge pressure ($\hat{P}_d$), may also be useful for system level control of rotary compressor.

For the observer to be truly sensorless, estimators must be used to replace $P_c$ and $P_d$ because these values are unknown and are used to determine the piecewise conditions which define $W_1$ and $W_2$. The discharge pressure ($P_d$) may be simply replaced with the estimated discharge pressure ($\hat{P}_d$). In addition, an observer for $P_c$ can be defined from the thermodynamic model as follows:

$$\hat{P}_c(t) \triangleq (W_1 + 1)\hat{P}_s + W_2\hat{P}_d$$

From this, the following realizable form of $W_1$ and $W_2$ can be defined based in part in the pressure estimator terms:

| Stage | Piecewise Condition | $W_1$ | $W_2$ |
|---|---|---|---|
| Compression | $\hat{P}_c(t) < \hat{P}_d$ | $\left(\frac{V_{TDC}}{V_c(\theta_m)}\right)^n - 1$ | 0 |
| Discharge | $\hat{P}_c(t) \geq \hat{P}_d$ | −1 | 1 |

FIGS. 8 and 9 depict exemplary control methods and models having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using rolling piston rotary compressor 100 as an example, it should be appreciated that these methods may be applied to the operation of any suitable compressor type and configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a rolling piston compressor, comprising:

obtaining an angular position and an angular speed of a rolling piston of the compressor;

obtaining an electromagnetic torque applied by an electric motor mechanically coupled to the rolling piston;

calculating a load torque exerted on the rolling piston using a load torque observer model based on the angular position of the rolling piston, the angular speed of the rolling piston, and the electromagnetic torque applied by the electric motor; and operating the electric motor to adjust the electromagnetic torque to be equivalent to the calculated load torque.

2. The method of claim 1, wherein the load torque observer model comprises:

$$T_L = \gamma WP = \left(2rl\sin\frac{\theta_c}{2}\right)\cdot\left((R-r)\sin\frac{\theta_c}{2}\right)[\,W_1 \quad W_2\,]\begin{bmatrix} P_s \\ P_d \end{bmatrix}$$

where $W_1$ and $W_2$ are defined by the following piecewise function

| | Piecewise Condition | $W_1$ | $W_2$ |
|---|---|---|---|
| Compression | $P_c(t) < P_d$ | $\left(\frac{V_{TDC}}{V_c(\theta_m)}\right)^n - 1$ | 0 |
| Discharge | $P_c(t) \geq P_d$ | −1 | 1 |

$\theta_m$ is the angular position of the rolling piston;

R is a radius of a cylindrical cavity;

r is a radius of the rolling piston;

$$\theta_c \triangleq \theta_m + \sin^{-1}\left(\frac{R-r}{r}\sin\theta_m\right);$$

l is a depth of the cylindrical cavity;

$$V_c \triangleq \left(\frac{2\pi-\theta_m}{2}\right)R^2 l - \left[\pi r - \frac{1}{2}(\theta_c r + (R-r)\sin\theta_c)\right]rl;$$

$V_{TDC}=\pi l(R^2-r^2)$;

$P_c$ is a cylindrical cavity pressure;

$P_s$ is a suction chamber pressure; and $P_d$ is a discharge pressure.

3. The method of claim 2, wherein the electromagnetic torque applied by the electric motor is regulated using a speed control algorithm comprising the following:

$$T_{em} = \hat{T}_L + \left(k_P + k_P\frac{1}{s}\right)e$$

where $\hat{T}_L$ is determined using the load torque observer model;

$T_{em}$ is the electromagnetic torque applied by the motor;

$e=\theta_m^*-\dot{\theta}_m$ where $\dot{\theta}_m^*$ is a desired or reference angular speed; and $k_p$ is a real, positive gain.

4. The method of claim 2, wherein the load torque is used to determine an angular acceleration of the rolling piston.

5. The method of claim 4, wherein the angular acceleration is determined using an acceleration observer, the acceleration observer comprising:

$$\ddot{\theta}_m \triangleq \frac{1}{J}\left[T_{em} - \gamma W\hat{P}\right] + (k_1+1)s$$

where

J is a combined moment of inertia for the electric motor and the piston;

$T_{em}$ is the electromagnetic torque applied by the motor;

$k_1$ is a real, positive gain value; and $$\hat{P} = \begin{bmatrix} \hat{P}_s \\ \hat{P}_d \end{bmatrix},$$

where $\hat{P}_s$ and $\hat{P}_d$ are estimated values of the suction pressure $P_s$ and the discharge pressure $P_d$.

6. The method of claim 5, wherein the estimated suction pressure $\hat{P}_s$ and the estimated discharge pressure $\hat{P}_d$ are estimated using a pressure estimator, the pressure estimator comprising:

$$\hat{P} \triangleq \int \dot{\hat{P}} \triangleq \int -\frac{1}{J}\gamma\Gamma W^T s \begin{cases} \int \dot{\hat{P}}_s \triangleq -\frac{k_P}{J}W_1 s \\ \int \dot{\hat{P}}_d \triangleq -\frac{k_P}{J}W_2 s \end{cases}$$

$$\text{where } \Gamma \triangleq \begin{bmatrix} k_p & 0 \\ 0 & k_p \end{bmatrix}$$

and $k_p$ is a real, positive gain.

7. The method of claim 1, wherein obtaining the angular position and the angular speed of a rolling piston comprises:

measuring the angular position and the angular speed using a tachometer or an encoder.

8. The method of claim 1, wherein obtaining the electromagnetic torque applied by the electric motor comprises:

obtaining the electromagnetic torque based on a measured motor current or a back electromotive force of the motor.

9. The method of claim 1, wherein the rolling piston compressor is used to compress a refrigerant in a sealed system of a refrigerator appliance.

10. A rolling piston compressor comprising:

a casing defining a cylindrical cavity defining a central axis, a suction port, and a discharge port;

an electric motor comprising a drive shaft, the drive shaft extending along the central axis;

a rolling piston positioned within the cylindrical cavity, the rolling piston being eccentrically mounted on the drive shaft;

a sliding vane that extends from the casing toward the rolling piston to maintain contact with the rolling piston as it rotates about the central axis, the sliding vane and the rolling piston dividing the cylindrical cavity into a suction volume in fluid communication with the suction port and a compression volume in fluid communication with the discharge port; and a controller operably coupled to the electric motor, the controller configured for:

obtaining an angular position and an angular speed of the rolling piston;

obtaining an electromagnetic torque applied by the electric motor;

calculating a load torque exerted on the rolling piston using a load torque observer model based on the angular position of the rolling piston, the angular speed of the rolling piston, and the electromagnetic torque applied by the electric motor; and operating the electric motor to adjust the electromagnetic torque to be equivalent to the calculated load torque.

11. The rolling piston compressor of claim 10, wherein the load torque observer model comprises:

$$T_L = \gamma WP = \left(2rl\sin\frac{\theta_c}{2}\right)\cdot\left((R-r)\sin\frac{\theta_c}{2}\right)[\,W_1 \quad W_2\,]\begin{bmatrix} P_s \\ P_d \end{bmatrix}$$

where $W_1$ and $W_2$ are defined by the following piecewise function

| | Piecewise Condition | $W_1$ | $W_2$ |
|---|---|---|---|
| Compression | $P_c(t) < P_d$ | $\left(\frac{V_{TDC}}{V_c(\theta_m)}\right)^n - 1$ | 0 |
| Discharge | $P_c(t) \geq P_d$ | −1 | 1 |

$\theta_m$ is the angular position of the rolling piston;

R is a radius of a cylindrical cavity;

r is a radius of the rolling piston;

$$\theta_c \triangleq \theta_m + \sin^{-1}\left(\frac{R-r}{r}\sin\theta_m\right);$$

l is a depth of the cylindrical cavity;

$$V_c \triangleq \left(\frac{2\pi-\theta_m}{2}\right)R^2 l - \left[\pi r - \frac{1}{2}(\theta_c r + (R-r)\sin\theta_c)\right]rl;$$

$V_{TDC}=\pi(R^2-r^2)$;

$P_c$ is a cylindrical cavity pressure;

$P_s$ is a suction chamber pressure; and $P_d$ is a discharge pressure.

12. The rolling piston compressor of claim 11, wherein the electromagnetic torque applied by the electric motor is regulated using a speed control algorithm comprising the following:

$$T_{em} = \hat{T}_L + \left(k_P + k_P\frac{1}{s}\right)e$$

where $T_{em}$ is the electromagnetic torque applied by the motor;

$\hat{T}_L$ is determined using the load torque observer model;

$e=\dot{\theta}_m^*-\dot{\theta}_m$ where $\dot{\theta}_m^*$ is a desired or reference angular speed; and $k_p$ is a real, positive gain.

13. The rolling piston compressor of claim 11, wherein the load torque is used to determine an angular acceleration of the rolling piston.

14. The rolling piston compressor of claim 13, wherein the angular acceleration is determined using an acceleration observer, the acceleration observer comprising:

$$\ddot{\theta}_m \triangleq \frac{1}{J}[T_{em} - \gamma W\hat{P}] + (k_1+1)s$$

where

J is a combined moment of inertia for the electric motor and the piston;

$T_{em}$ is the electromagnetic torque applied by the motor;

$k_1$ is a real, positive gain value; and $$\hat{P} = \begin{bmatrix} \hat{P}_s \\ \hat{P}_d \end{bmatrix},$$

where $\hat{P}_s$ and $\hat{P}_d$ are estimated values of the suction pressure $P_s$ and the discharge pressure $P_d$.

15. The rolling piston compressor of claim 14, wherein the estimated suction pressure $\hat{P}_s$ and the estimated discharge pressure $\hat{P}_d$ are estimated using a pressure estimator, the pressure estimator comprising:

$$\hat{P} \triangleq \int \dot{\hat{P}} \triangleq \int -\frac{1}{J}\gamma\Gamma W^T s \begin{cases} \int \dot{\hat{P}}_s \triangleq -\frac{k_P}{J}W_1 s \\ \int \dot{\hat{P}}_d \triangleq -\frac{k_P}{J}W_2 s \end{cases}$$

$$\text{where } \Gamma \triangleq \begin{bmatrix} k_p & 0 \\ 0 & k_p \end{bmatrix}$$

and $k_p$ is a real, positive gain.

16. The rolling piston compressor of claim 10, wherein obtaining the angular position and the angular speed of a rolling piston comprises:

measuring the angular position and the angular speed using a tachometer or an encoder.

17. The rolling piston compressor of claim 10, wherein obtaining the electromagnetic torque applied by the electric motor comprises:

obtaining the electromagnetic torque based on a measured motor current or a back electromotive force of the motor.

18. The rolling piston compressor of claim 10, wherein the rolling piston compressor is used to compress a refrigerant in a sealed system of a refrigerator appliance.

* * * * *